US005716039A

United States Patent [19]

Jones

[11] Patent Number: 5,716,039

[45] Date of Patent: Feb. 10, 1998

[54] ACTUATING LEVER

[75] Inventor: Christopher R. Jones, Greensboro, N.C.

[73] Assignee: Templex, Inc., Thomasville, N.C.

[21] Appl. No.: 361,288

[22] Filed: Dec. 22, 1994

[51] Int. Cl.[6] ..... F16K 31/62; D05B 81/00

[52] U.S. Cl. ..... 251/295; 251/244; 74/512; 112/282

[58] Field of Search ..... 251/244, 245, 251/246, 295, 279; 112/282; 74/512

[56] References Cited

U.S. PATENT DOCUMENTS

| | | | |
|---|---|---|---|
| 1,970,039 | 8/1934 | Fraser | 251/295 |
| 2,095,200 | 10/1937 | Thompson | 251/295 |
| 2,881,784 | 4/1959 | Bryant | 251/244 |
| 2,929,405 | 3/1960 | Beebe | 251/295 |
| 3,853,079 | 12/1974 | Dunne | 112/282 |
| 4,709,645 | 12/1987 | Jones et al. | 112/282 |
| 4,764,058 | 8/1988 | Jones et al. | 112/282 |
| 5,199,119 | 4/1993 | Weber | 251/295 |

FOREIGN PATENT DOCUMENTS

| | | | |
|---|---|---|---|
| 283696 | 3/1931 | Italy | 251/295 |

*Primary Examiner*—George L. Walton
*Attorney, Agent, or Firm*—Clifton Ted Hunt

[57] ABSTRACT

The actuating lever of this invention is intended for use with an air valve having a normally extending valve stem. The actuating lever has utility in many fields. One illustrated embodiment is described in association with an air valve in the waste removal system of a sewing machine, wherein it is desired that the air valve be activated before the sewing machine is activated by depression of a treadle. It is normally desired to initiate the flow of compressed air to create a suction for the removal of waste generated by operation of the sewing machine before the sewing machine is started. The configuration of the actuating lever provides a mechanical advantage that, in the illustrated embodiment, enables the valve stem of the air valve to be depressed with less pressure on the treadle than was required in the prior art, and with less pressure than is required to start the motor of the sewing machine. The flow of compressed air and the creation of suction for waste removal before activation of the sewing machine motor is assured by the actuating lever.

4 Claims, 12 Drawing Sheets

POSITION 2
MACHINE - IDLE
AIR SWITCH - FULLY ACTIVATED

POSITION 3
MACHINE - ENGAGED
AIR SWITCH - FULLY ACTIVATED

ACTUATING LEVER

FIELD OF THE INVENTION

This invention is an actuating lever having utility in the sequential starting of the functions of two groups of apparatus needed to perform a desired task. One embodiment of the actuating lever will be described in association with the introduction of compressed air into the waste removal system of a commercial sewing machine, but the actuating lever has utility in other areas.

BACKGROUND OF THE INVENTION

The use of pneumatic waste removal systems with commercial sewing machines has long been known. See, for example, U.S. Pat. No. 3,853,079 issued Dec. 10, 1974 to Dunne for DOUBLE SUCTION UNIT, U.S. Pat. No. 4,709,645 issued Dec. 1, 1987 to Jones, et al. for WASTE FABRIC AND LINT COLLECTION BOX FOR A SEWING MACHINE, and U.S. Pat. No. 4,764,058 issued Aug. 16, 1988 to Jones, et al. for DUAL SUCTION UNIT AND METHOD.

Air switches have long been used to control the flow of air in the environment of sewing machines. Many of these switches were actuated by manipulation of the treadle. See, for example, U.S. Pat. No. 1,559,267 issued Oct. 27, 1925 to Lipschitz for FUR SEAMING MACHINE; U.S. Pat. No. 1,850,708 issued Mar. 22, 1932 to Davis for SEWING MACHINE; U.S. Pat. No. 3,245,369 to Myska for SERVO-SYSTEM FOR SEWING MACHINES; and U.S. Pat. No. 4,280,425 to Croyle for METHOD AND APPARATUS FOR ELECTRO-PNEUMATIC CONTROL OF A STITCHING MACHINE. None of the air switches in these patents were used to activate a pneumatic waste removal system for a sewing machine when the treadle is depressed.

The prior art air switches that were activated by depression of a sewing machine treadle were sometimes not engaged by a depressed treadle until after depression of the treadle had activated the sewing machine and waste fabric and lint were generated without compressed air being provided to create suction to remove the waste fabric and lint. Without suction, the waste material undesirably accumulated.

SUMMARY OF THE INVENTION

It is an object of the invention to provide an actuating lever for use in a variety of environments where it is desirable that an apparatus to perform one function be started slightly before the starting of a second apparatus that performs a second function to be performed concurrently with the first function to produce a desired result.

In the illustrated embodiment of the invention, the actuating lever is described in the environment of a treadle rod air switch assembly that introduces the flow of compressed air into the waste removal system of a commercial sewing machine before the sewing machine is activated by downward pressure applied to the treadle of the sewing machine motor.

The actuating lever is pivotally mounted on the valve housing in a treadle rod air switch assembly with a convex medial portion of the actuating lever resting against the normally extended valve stem of the air valve. One end of the actuating lever terminates in engagement with the lower surface of a block on the treadle rod.

When the the treadle rod is pulled down by depressing the treadle, the block on the treadle rod moves the one end of the lever downwardly. The convex medial portion of the actuating lever and the valve stem of the air valve are correspondigly moved downwardly, activating the air valve and causing air to be admitted to the sewing machine's waste removal system before the downward motion of the treadle rod is translated to the motor operating lever of the sewing machine's electric motor.

A detailed description of the invention follows, which will be better understood when read in conjunction with the accompanying drawings, wherein:

BRIEF DESCRIPTION OF THE DRAWINGS OF THE ILLUSTRATED EMBODIMENT

FIG. 1 is a somewhat schematic perspective view illustrating a waste removal system of a sewing machine;

FIGS. 2A is a side view of a treadle, treadle rod air switch assembly and sewing machine motor, illustrating the prior art use of a treadle rod air switch assembly, with an inset showing a front view of the treadle rod air switch assembly with the valve stem of the air valve in its normally extended and closed or inactive position. For purposes of illustration, FIG. 2A and the remaining figures show the treadle rod air switch assembly in the reverse position from the position it normally occupies on the treadle rod in actual use;

Figure 5A:
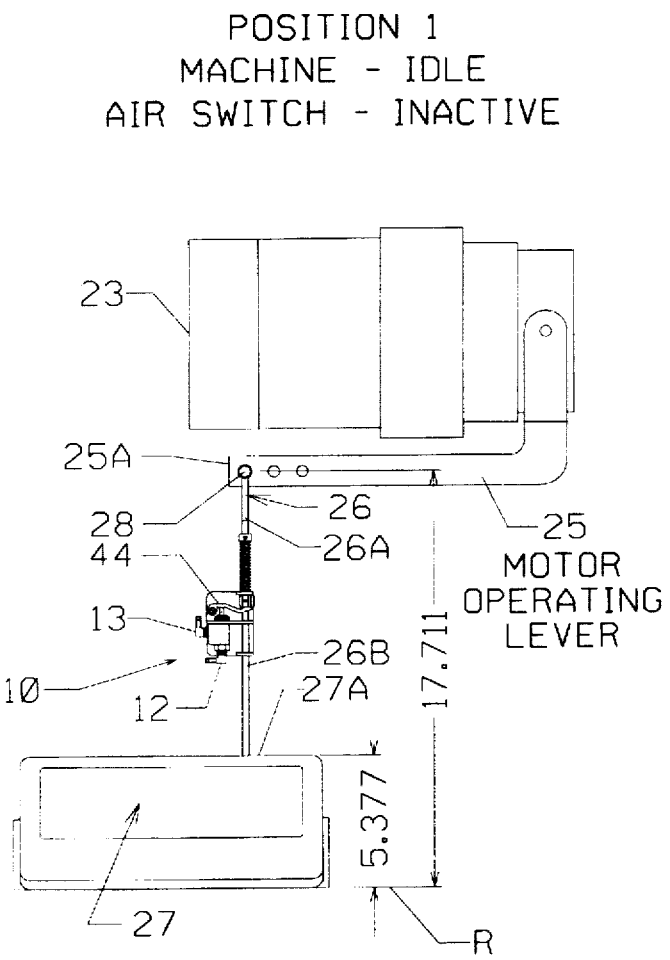
Figure 5B:
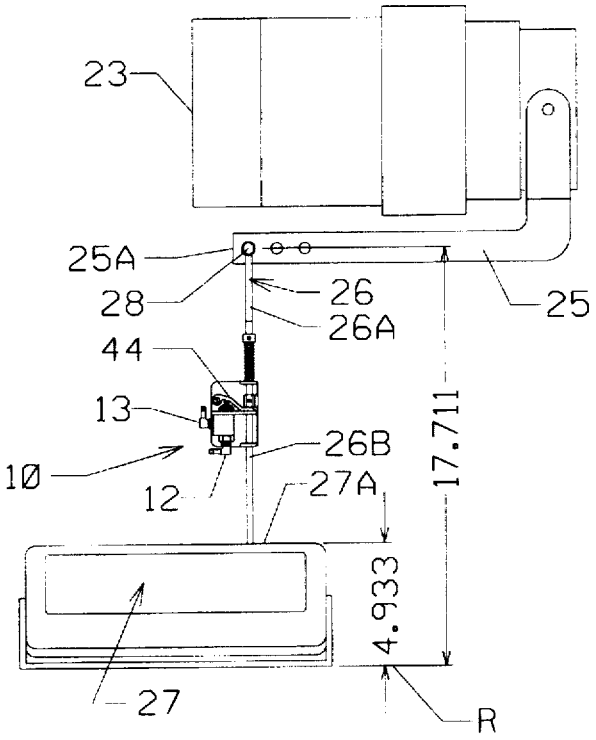
Figure 5C:
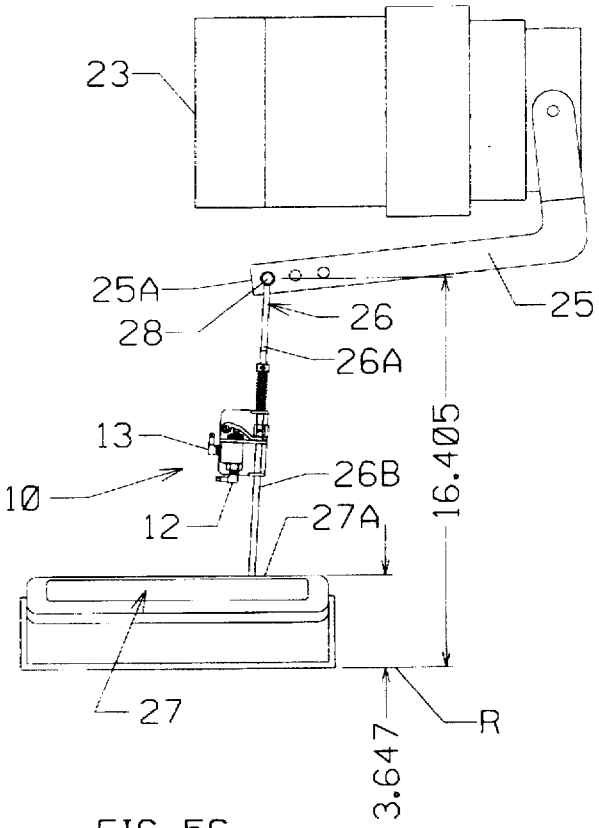
Figure 6:
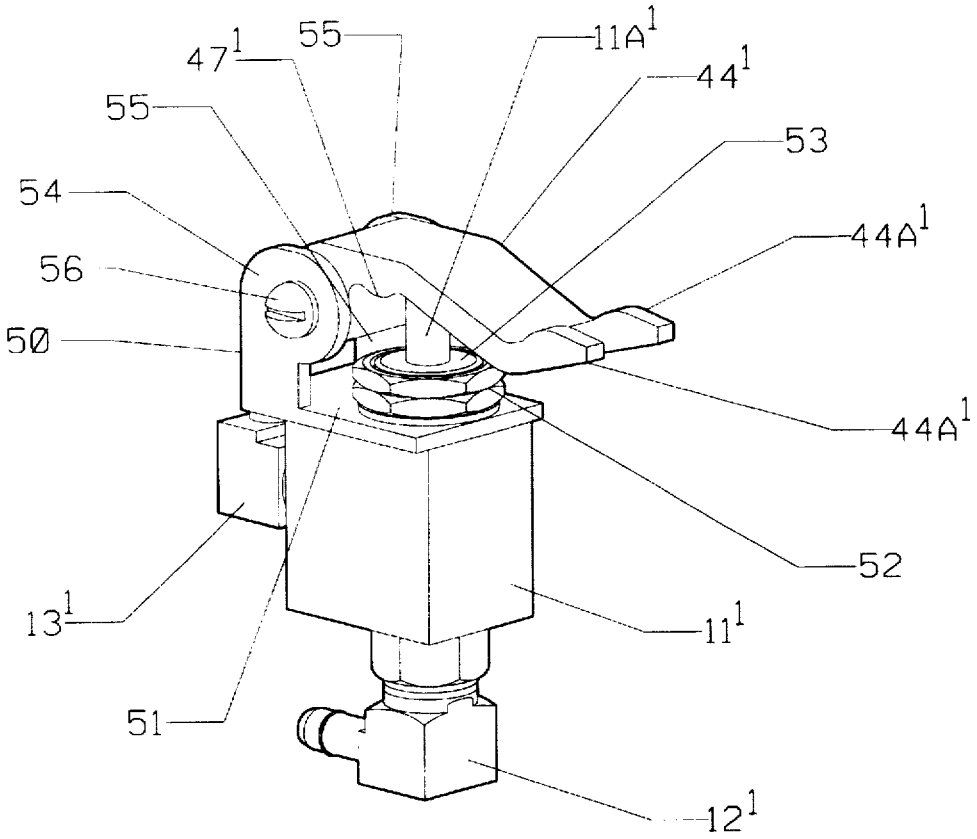

FIGS. 5A, 5B, and 5C, are sequential front views illustrating the sequential actuation of the air valve and of the sewing machine motor's motor operating lever by the treadle rod air switch assembly and the actuating lever of the present invention;

FIG. 6 is a perspective view of a second embodiment of the invention; and

Figure 7:
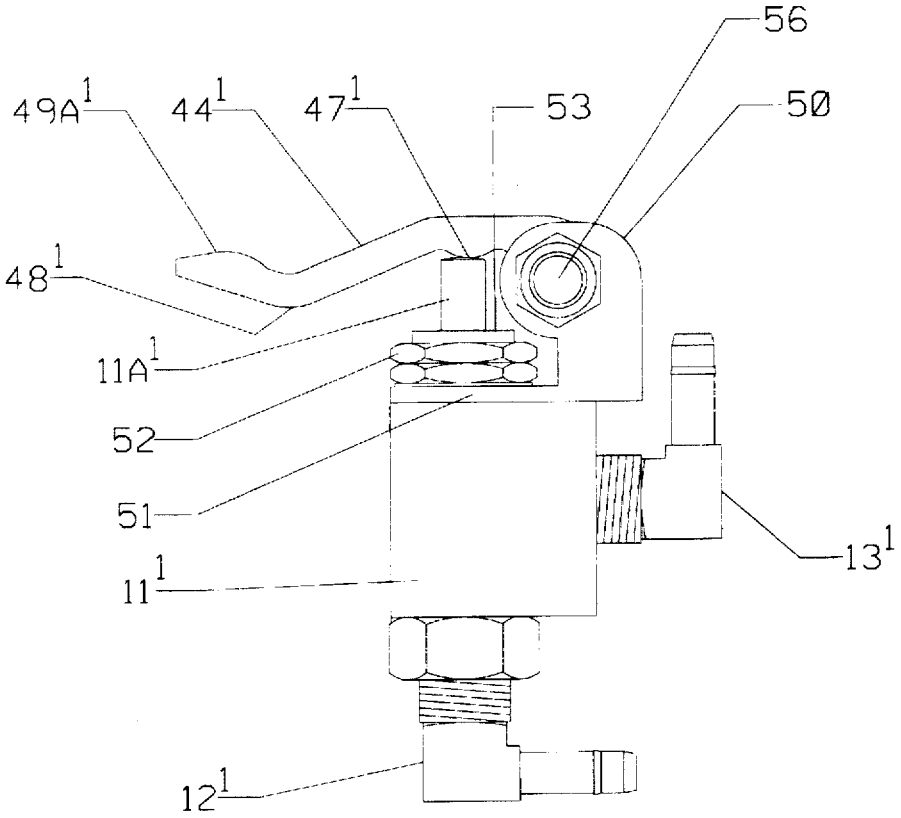

FIG. 7 is a side view of the embodiment shown in FIG. 6.

DETAILED DESCRIPTION OF THE INVENTION

Referring more specifically to the drawings, a treadle rod air switch assembly is broadly indicated at 10. The treadle rod air switch assembly 10 includes an air valve 11 with a spring pressed valve stem 11A that normally extends beyond the body of the air valve in the closed or inactive position of the air valve. The valve stem 11A is depressed to open or activate the air valve.

The body of the air valve 11 is operatively connected to a compressed air inlet 12 and a compressed air outlet 13. The air inlet 12 is connected to a source of compressed air and the air outlet 13 is connected to an air duct 14 extending from the air switch 10 to the waste removal system, broadly indicated at 15 in FIG. 1, of a commercial sewing machine 16.

Figure 1:
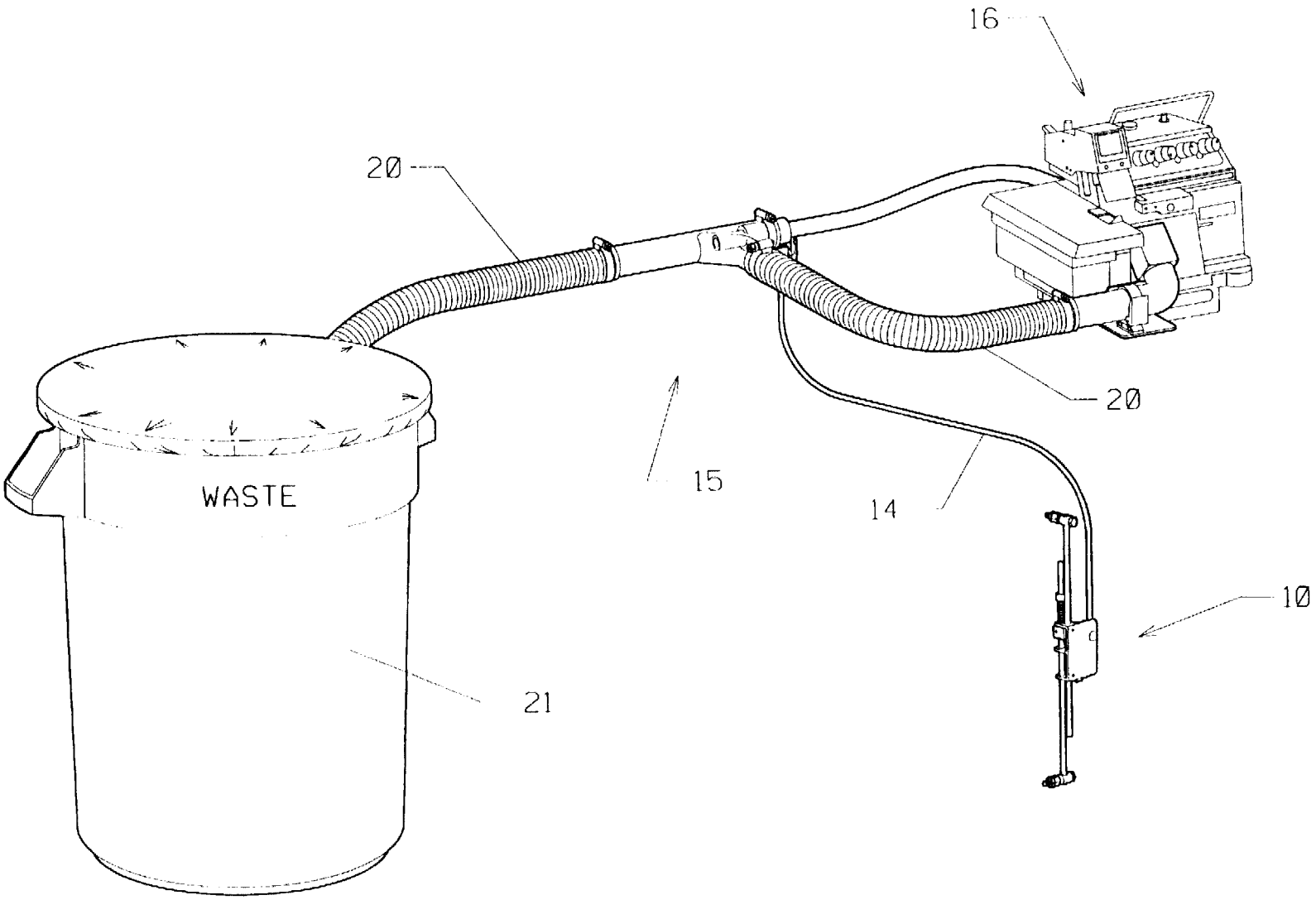

As seen in FIG. 1, the waste removal system includes the air duct 14 and a waste carrying duct 20 extending from the sewing machine 16 to a waste container 21.

Figure 3A:
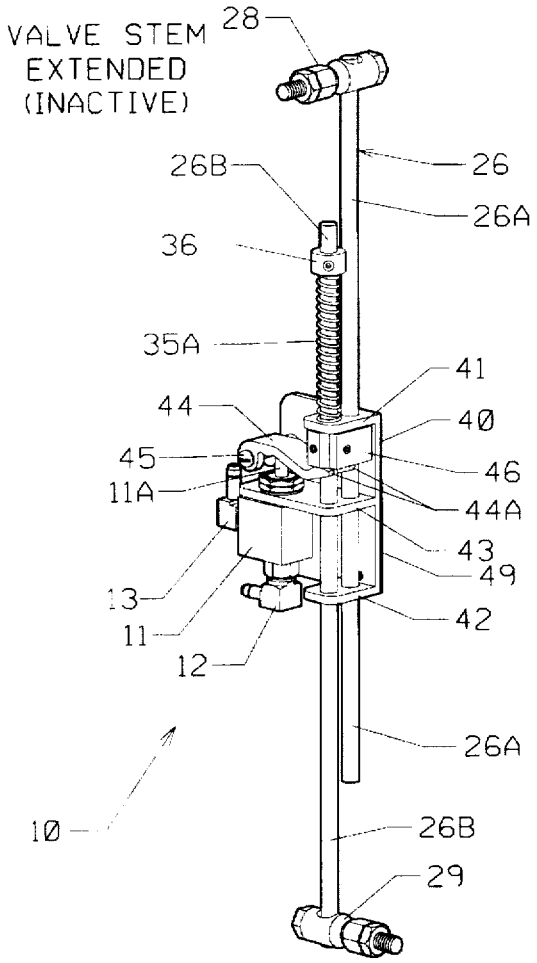
FIG. 3A is a perspective view of a treadle rod air switch assembly incorporating the actuating lever of the present invention and showing the valve stem of the air valve extended in its normally closed or inactive position.
Figure 3B:
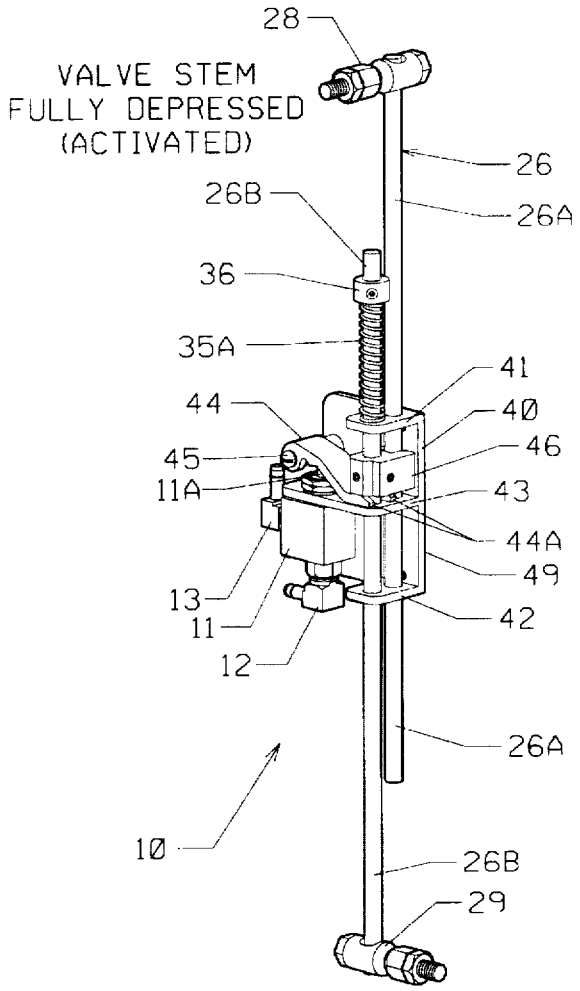
FIG. 3B is a perspective view similar to FIG. 3A but showing the valve stem of the air valve depressed in its open or active position.
Figure 4:
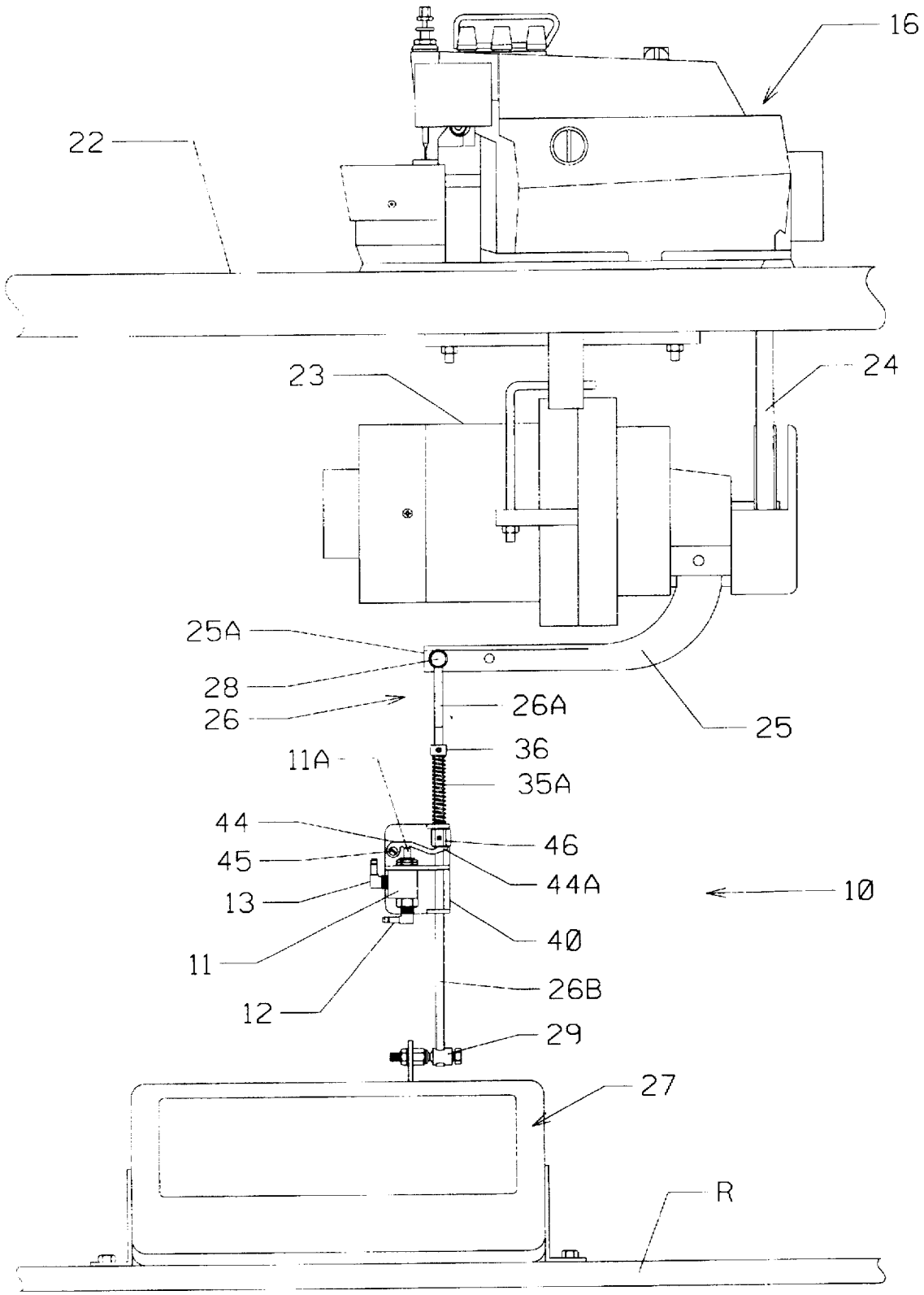
FIG. 4 is a front view of a treadle rod air switch assembly operatively installed between a sewing machine motor's operating lever and the sewing machine's treadle.

Referring to FIG. 4, the sewing machine 16 is customarily mounted on a table 22 with its motor 23 beneath the table. The sewing machine is operatively connected to the motor 23 by a belt 24. In the illustrated embodiment, an L-shaped motor operating lever 25 depends from the motor with its outer end 25A connected as at 28 to the upper end of a treadle rod broadly indicated at 26. As best seen in FIGS. 3A, 3B, and 4, the treadle rod 26 comprises an upper stationary portion 26A, depending from the motor operating lever 25, and a lower vertically movable portion 26B extending upwardly from its connection 29 to a treadle 27 mounted on a treadle rail R.

A valve housing 40 connects the stationary portion 26A and the vertically movable treadle rod 26B. The housing 40 has a planar body 49 extending in parallel relation to the treadle rod 26A, and flanges 41, 42 and 43 extend perpendicularly from the body 49. The stationary treadle rod 26A extends through openings in the flanges 41, 42, and 43, and the rod 26A is fastened to the valve housing 40.

The Conventional Installation of A Treadle Rod Air Switch

Figure 2A:
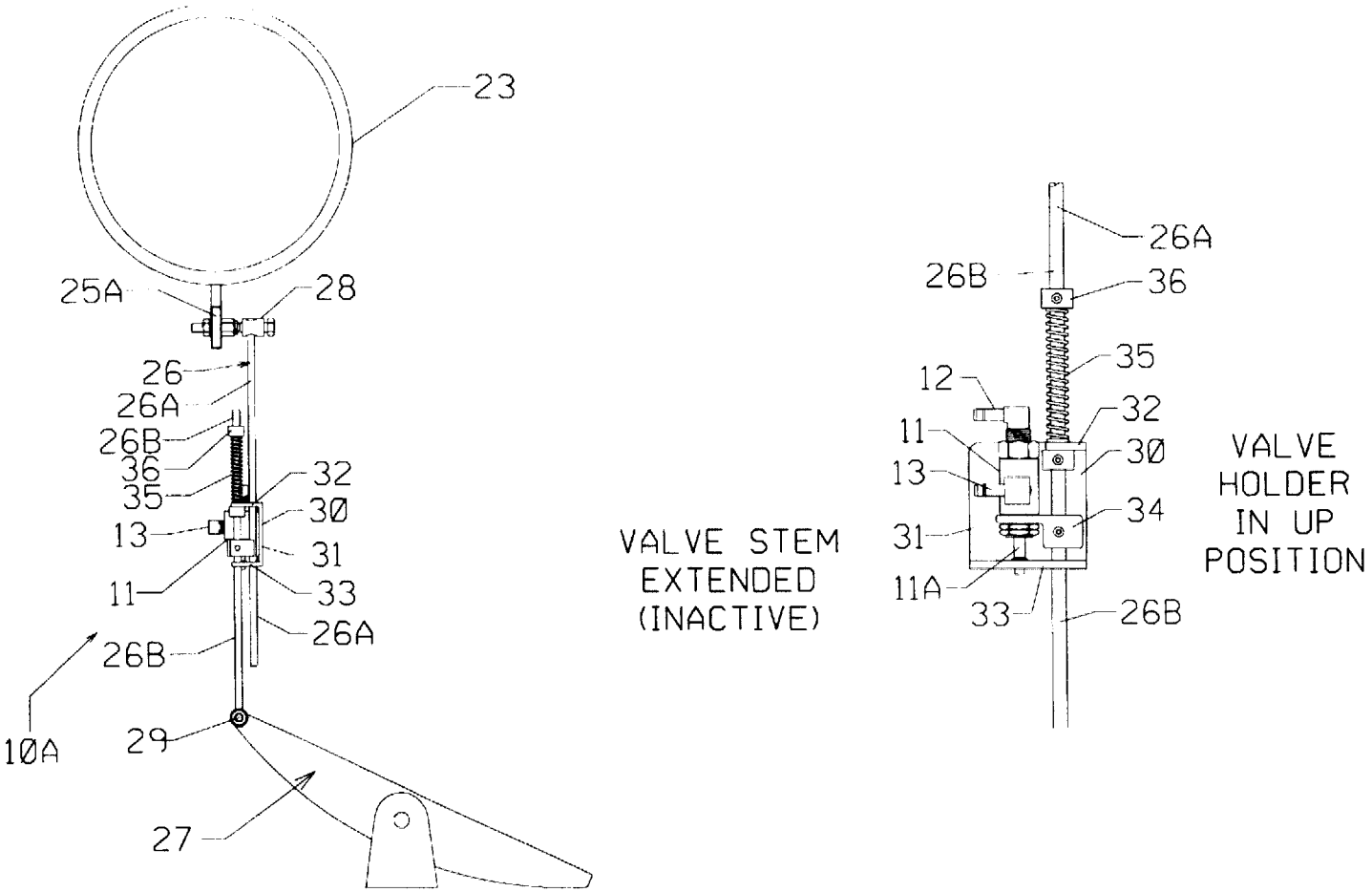
FIG. 2A (PRIOR ART)
FIG. 2B is a view similar to FIG. 2A but with an inset showing a front view of the treadle rod air switch assembly with the valve stem of the air valve in its depressed and open or active position.
Figure 2B:
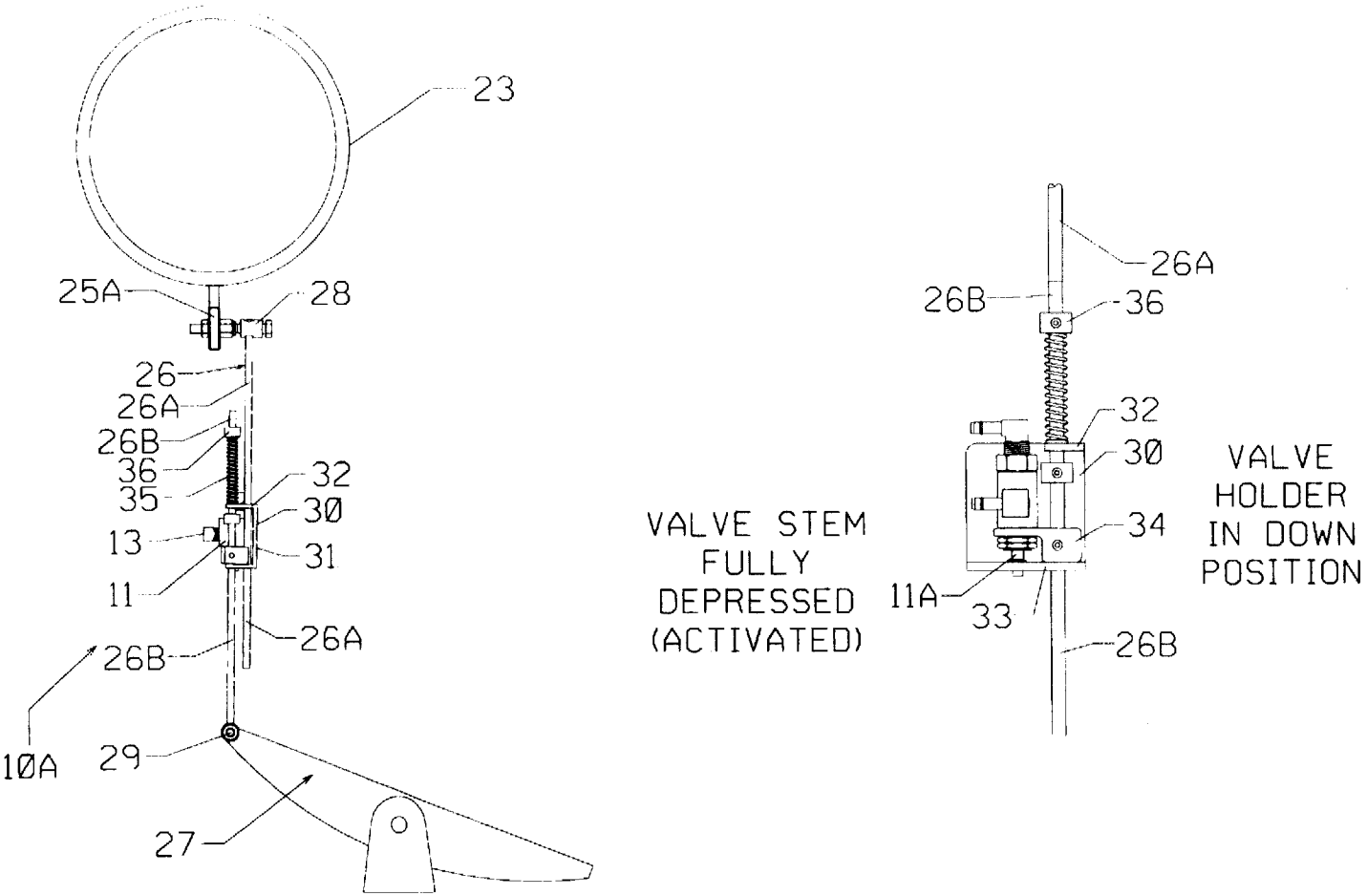
FIG. 2B (PRIOR ART)

A treadle rod air switch assembly widely used before the present invention is broadly indicated at 10A in FIGS. 2A and 2B. The same air valve 11 was used in the prior art as is used in the present invention. The prior art treadle rod air switch 10A includes the air valve 11 with a spring pressed valve stem 11A, an air inlet 12 and an air outlet 13.

The air valve 11 is attached to the treadle rod 26B by a valve holder 34. A tension spring 35 surrounds the treadle rod 26B and extends between a collar 36 fixed to the rod 26B and the top flange 32 of a valve housing 30. The spring 35 normally supports the valve holder 34 and air valve 11 and treadle 27 with the extended valve stem 11A above the flange 33 of housing 30. Downward pressure on the treadle 27 moves the valve holder 34 and air valve 11 downwardly relative to the flange 33, moving the valve stem 11A against the flange 33, whereby the valve stem is depressed to actuate the air switch and release a flow of compressed air.

In conventional practice, an operator's foot applies downward pressure to the treadle 27, causing the treadle rod 26 to move the free end 25A of the motor operating lever 25 downwardly to start the sewing machine motor 23 at the same time as the air valve 11 is activated to introduce a flow of compressed air to the waste removal system. Because it required more pressure (approximately three pounds, six ounces at 80 psi) to depress valve stem 11A and activate air valve 11 than to activate some sewing machine motors, the sewing machine was often started before the prior use of air valve 11 activated a flow of air to the waste removal system.

To use the treadle rod air switch assembly of the prior art, it was necessary to make adjustments to the motor lever tension for air to be activated in time. These adjustments increase operator fatigue because of the requirement for increased pressure on the treadle.

The Improved Actuating Mechanism

The treadle rod air switch assembly 10 is shown in FIGS. 3A, 3B, 3C, 3D, 4, 5A, 5B, and 5C with the improved actuating mechanism of this invention. The improved actuating mechanism comprises a valve housing 40 with upper and lower flanges 41 and 42 connected to the treadle rod 26A. A third flange 43 extends perpendicularly from the housing 40 in spaced parallel relation between the upper flange 41 and the bottom flange 42. The intermediate flange 43 supports the air valve 11 with the valve stem 11A directed upwardly.

An actuating lever, broadly indicated at 44, is pivotally connected at one end to the housing 40 by a pivot fulcrum stud 45. The actuating lever 44 extends from its pivotal connection 45 across the valve stem 11A and the other or free end 44A of the actuating lever 44 straddles the treadle rod 26B (FIG. 3A) and terminates in engagement with a block 46 fastened to the rod 26B.

Figure 3C:
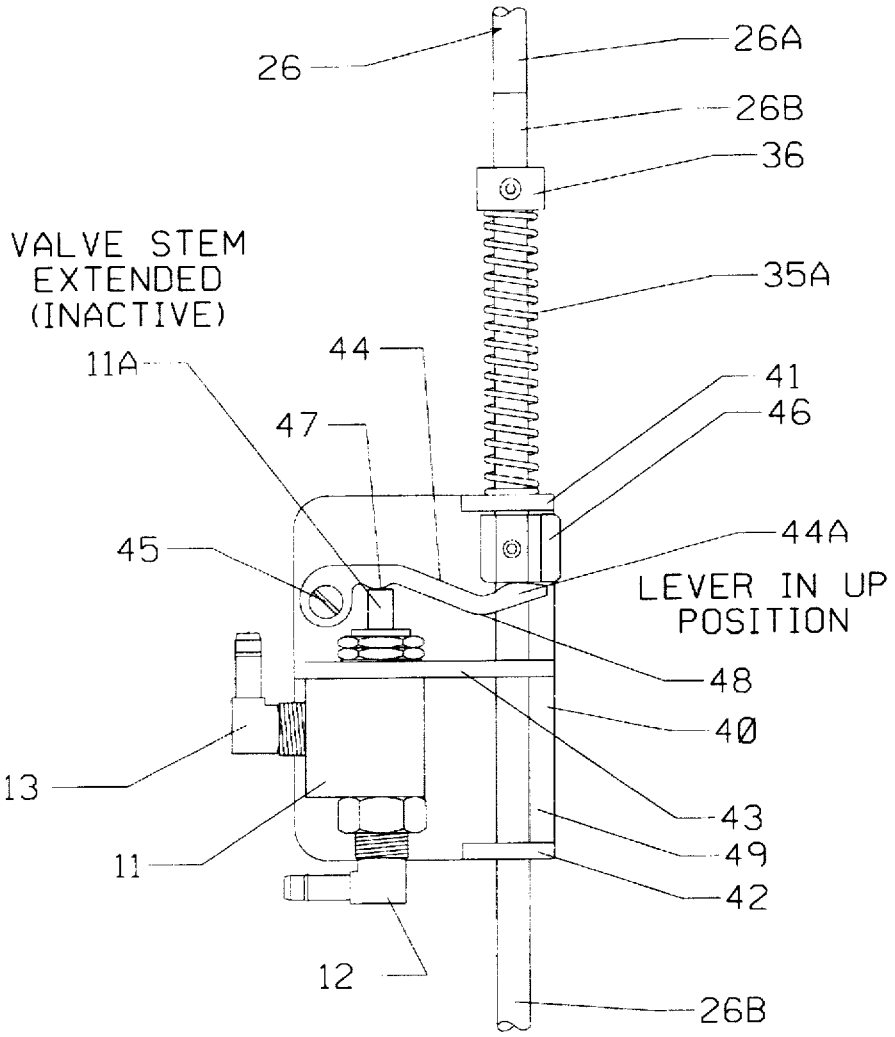
FIG. 3C is a front view of the treadle rod air switch assembly shown in FIG. 3A.
Figure 3D:
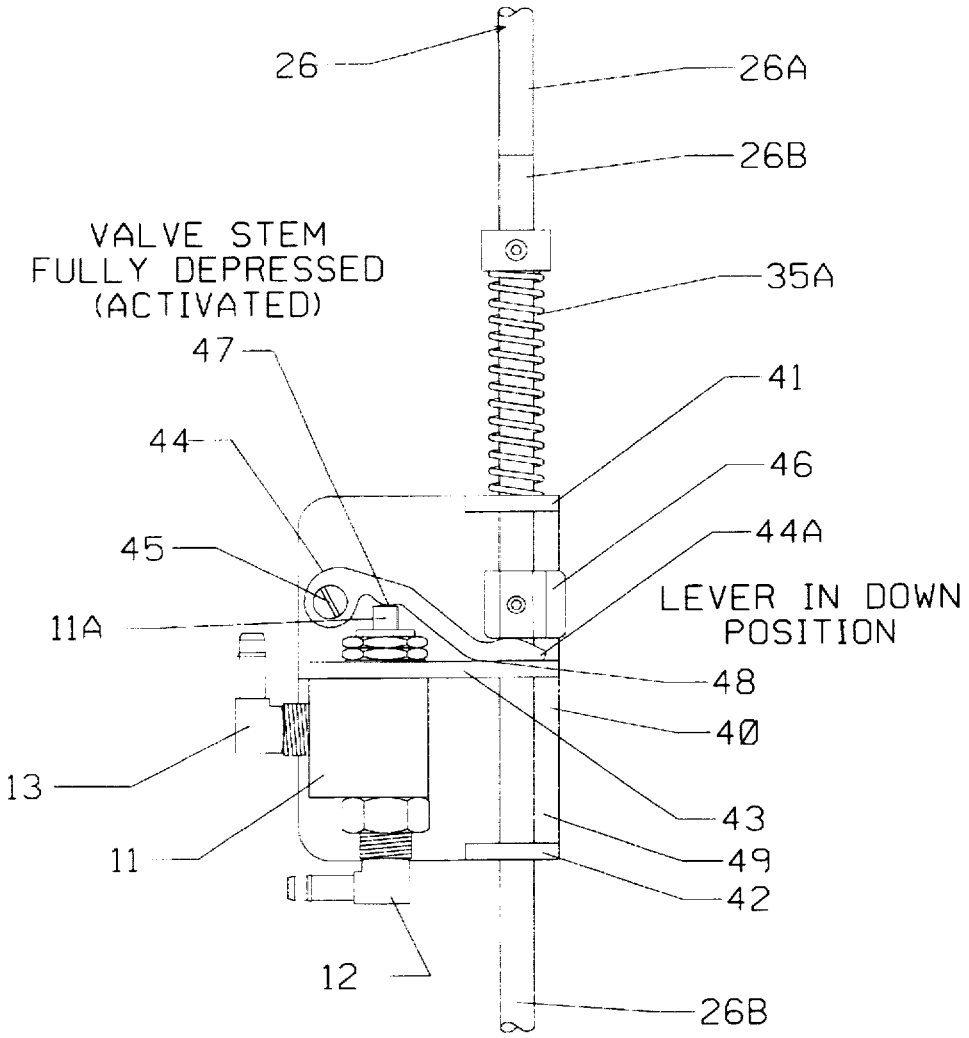
FIG. 3D is a front view of the treadle rod air switch assembly shown in FIG. 3B.

As best seen in FIGS. 3C and 3D, a portion 47 of the actuating lever 44 curves downwardly to permanently engage the valve stem 11A. The medial portion of the actuating lever extends downwardly at an angle from the curve or bulge 47 to the lowermost portion 48 of the actuating lever 44 in FIG. 3C. The portion 48 of the actuating lever rests on flange 43 when the air valve 11 is activated. The portion 48 supports the additional force that is required to activate the motor. The medial portion of the actuating lever then extends upwardly in FIG. 3C to the free end 44A of the lever.

This configuration of the actuating lever 44 is advantageous in instantly transmitting downward motion of the treadle rod 26 to the valve stem 11A, requiring only a few ounces of pressure on the treadle 27 to depress the valve stem 11A and initiate the flow of compressed air to the waste removal system.

The collar 36 on the movable portion 26B of the treadle rod 26 provides an adjustment for the amount of pressure needed to depress the actuating lever 44 and the valve stem 11A. In the illustrated embodiment, the spring on the treadle rod exerts less tension than the prior art spring and is designated at 35A in the drawings. As the collar 36 is raised, the pressure on the spring 35A is lessened. When the collar 36 is raised on the treadle rod 26B above the spring 35A and there is no pressure on the spring 35A, the weight of the treadle 27 is, by itself, sufficient to depress the lever 44 and valve stem 11A. As the collar 36 is lowered to increase the pressure on the spring 35A, additional pressure on the treadle 27 is required to depress the actuating lever 44 and the valve stem 11A.

The position of the collar 36 on the movable treadle rod 26B can be easily adjusted to require less pressure on the treadle to move the actuating lever, and thereby depress the valve stem and activate the air valve, than is required to activate the sewing machine motor. The desirable result is that, with the actuating lever 44, the flow of air to the waste removal system is reliably initiated before the generation of waste by operation of the sewing machine.

This desirable result is graphically illustrated in FIGS. 5A, 5B, and 5C, wherein illustrative measurements are given of the distance the treadle 27 travels to activate the air valve 11 and to activate the motor operating lever 25 to start the sewing machine 16.

FIG. 5A shows the treadle 27 in the "neutral" position with the top 27A of the treadle spaced 5.377 inches above the treadle rail R and the motor operating lever 25 of the sewing machine spaced 17.111 inches above the treadle rail.

In FIG. 5B, the treadle has been depressed only 0.444 of an inch to fully depress valve stem 11A and activate the air valve 11, and the motor operating lever 25 remains 17.111 inches above the treadle rail R and has not moved to activate the sewing machine motor 23.

FIG. 5C shows it necessary to depress the treadle another 1.286 inches from the position of FIG. 5B and lower the motor operating lever 1.306 inches to fully activate the sewing machine motor 23.

THE EMBODIMENT OF FIGS. 6 AND 7

The actuating lever of the second embodiment, shown in FIGS. 6 and 7, is of the same structure as the actuating lever 44, previously described, and is indicated at 44$^1$. Other like parts in the second embodiment are designated by the same reference number as in the first embodiment but with the prime notation added.

In the second embodiment, shown in FIGS. 6 and 7, the actuating lever 44$^1$ is pivotally connected directly to an air valve 11$^1$ by a bracket 50. The only difference between the first and second embodiments of the invention is that the actuating lever 44 in the first embodiment is supported by the valve housing 40, while the actuating lever 44$^1$ in the second embodiment is supported by the air valve 11$^1$.

The bracket 50 comprises an apertured base or body portion 51 on top of the valve body 11$^1$. The bracket 50 is held in place by jam nuts 52 overlying the body portion 51 and threaded to the valve port 53 of air valve 11$^1$. Valve stem 11A$^1$ rises through the aperture (not shown) in the center of the body portion 51 and through the valve port 53.

Opposed flanges 54 and 55 extend perpendicularly from opposite sides of the body portion 51 and support opposite ends of a pivot fulcrum stud 56. The stud 56 extends through the end portion of the actuating lever 44$^1$ opposite its free end 44A$^1$.

The flanges 54, 55, the pivot fulcrum stud 56, and the actuating lever 44$^1$ are so positioned relative to the valve stem 11A$^1$ that a bulge 47$^1$ on the actuating lever 44$^1$ operably engages the extended valve stem 11A$^1$ in the same manner as described in connection with the first embodiment of the invention. And, as seen in FIG. 7, the medial portion of the actuating lever extends downwardly at an angle from the bulge 47$^1$ to a portion 48$^1$ of the actuating lever 44$^1$ beneath the free end of the valve stem 11A$^1$, as in the first embodiment of the invention.

A pressure of only a few ounces on the free end 44A$^1$ of the activating lever 44$^1$ will depress the valve stem 11A$^1$ and initiate the flow of compressed air through an air outlet 13$^1$ for any desired purpose. It is apparent, therefore, that the utility of the actuating lever of this invention is not limited to the environment of a treadle rod air switch, but is useful wherever it is desired to activate an air valve with only a few ounces of pressure.

CONCLUSION

There is thus provided an actuating lever that will reliably activate an air valve in response to the application of only a few ounces of pressure on the free end of the activating lever.

Although specific terms have been used to describe the invention, they have been used in a generic and descriptive sense only and not for the purpose of limitation. The intended scope of the invention is set forth in the appended claims to invention.

I claim:

1. A treadle rod air switch assembly having an air valve with a movable valve stem that controls the flow of compressed air to a waste removal system for a sewing machine having a motor and a motor operating lever that is moved to start the motor, the treadle rod air switch assembly having a treadle and a treadle rod having a stationary portion and a vertically movable portion, the treadle rod air switch assembly further comprising:

(a) a valve housing connecting the stationary portion and the vertically movable portions of the treadle rod;

(b) means connecting the air valve to the valve housing with the valve stem extending outwardly from the air valve in its inactive position;

(c) an actuating lever extending transversely across the valve housing and including an engagement portion overlying the valve stem and a free end portion operably connected to the movable portion of the treadle rod;

(i) means operably connecting the air valve to the valve housing; and (d) means causing the actuating lever to be responsive to movement of the movable portion of the treadle rod in one direction to depress the valve stem and activate the flow of compressed air to the waste removal system, whereby the air valve is actuated prior to actuating of the motor in order to provide compressed air for removing waste from the sewing machine and delivering it to a waste removal system.

2. The invention of claim 1 wherein the means causing the actuating lever to be responsive to movement of the vertically movable portion of the treadle rod in one direction is a block fastened to the vertically movable portion of the treadle rod in position to engage the free end portion of the actuating lever when the vertically movable portion of the treadle rod moves in one direction.

3. The invention of claim 2 wherein the one direction is the downward direction of the movable portion of the treadle rod in response to the application of downward pressure on the treadle.

4. The invention of claim 1 wherein the free end of the actuating lever straddles the vertically movable portion of the treadle rod.

* * * * *